United States Patent [19]

Clausing

[11] 4,174,102

[45] Nov. 13, 1979

[54] SHEET SEPARATING AND FEEDING APPARATUS

[75] Inventor: Don P. Clausing, Rochester, N.Y.

[73] Assignee: Xerox Corporation, Stamford, Conn.

[21] Appl. No.: 812,217

[22] Filed: Jul. 1, 1977

[51] Int. Cl.[2] ..... B65H 3/04

[52] U.S. Cl. ..... 271/35; 271/165; 271/167

[58] Field of Search ..... 271/35, 121-125, 271/104, 102, 137, 138, 165, 167, 166, 101

[56] References Cited

U.S. PATENT DOCUMENTS

| | | | |
|---|---|---|---|
| 3,108,801 | 10/1963 | Van Dalen | 271/34 X |
| 3,485,489 | 12/1969 | Lindquist | 271/34 X |
| 3,523,685 | 8/1970 | Ehlscheid | 271/101 X |
| 3,734,490 | 5/1973 | Parks | 271/34 |
| 3,895,791 | 7/1975 | Kramell | 271/35 |
| 3,934,869 | 1/1976 | Strobel | 271/35 |
| 3,944,210 | 3/1976 | McInerny | 271/35 X |
| 3,949,979 | 4/1976 | Taylor | 271/35 X |
| 3,990,694 | 11/1976 | Mason | 271/35 |

*Primary Examiner*—Richard A. Schacher

[57] ABSTRACT

Improved sheet separating and feeding apparatus that opens or partially opens the retard nip after the sheet has partially passed through the retard nip.

8 Claims, 10 Drawing Figures

SHEET SEPARATING AND FEEDING APPARATUS

This invention relates to a sheet separating and feed apparatus for feeding individual sheets from a stack.

In modern high speed sheet processing machines such as printer, sorter, collator, reproduction machines, etc. a sheet misfeed or multi-fed sheets can seriously impair the operation of the machine. Numerous devices of the type disclosed in U.S. Pat. No. 3,768,803 have been employed to minimize the possibility of misfeeds and multi-fed sheets. Bottom feed devices normally encounter problems due to an excessive weight or constantly varying of sheets that is encountered which interferes with the removal of a sheet from the bottom of the stack. Thus, while a bottom feed device is more convenient than a top feeding device since the stack may be replenished without stopping the machine operation and the necessity of an elevator is obviated poor sheet feeding characteristics of bottom feeding devices have prevented common acceptance thereof.

A major problem associated with sheet feed devices is in feeding papers of varying weights and surface characteristics. With the advent of high speed reproduction machines the need for an apparatus adapted to place documents to be copied on the platen or viewing station of a copying machine and then remove them therefrom in a rapid and trouble free manner has been recognized. However, most sheet feed devices are designed specifically for a particular type or weight of paper having known surface characteristics. Thus, for example, in feeding virgin sheets upon which the copy is to be made into a reproduction machine the sheet feed may be designed specifically for copy paper. However, due to the fact that a wide variety of paper is utilized in the production of original documents and the fact that a stack of original documents to be copied by reproduction machine may range from extremely heavy paper all the way to onion skin, it is extremely difficult to provide a sheet feed which will consistently feed intermixed stack of documents. If the document feed is designed to handle lightest weight paper which may be encountered in all probability it will not feed heavy stock paper. At the other extreme if the feeder is designed to handle heavy weight paper there is a possibility that the feeder would severely mutilate light weight paper such as an onion skin.

Light weight sheets having a low intersheet frictional characteristic require a very small force to separate individual sheets from a stack. Further the retard force necessary to minimize the possibility of a multi-feed may also be very low. At the opposite extreme a great deal of force must be exerted on heavyweight paper or paper having high intersheet frictional characteristics and a retard force necessary to prevent multifeeds must also be fairly high.

The present invention overcomes the above mentioned difficulties by employing a retractable feed belt such that when the lead edge of the first sheet enters a positive drive subsequent to the feed belt and the feed belt is retracted from the sheet stack and the retard member. In this manner the belt no longer touches the sheet and the forces on the stack and retard are greatly reduced. The present invention is specifically an improvement over U.S. Pat. No. 3,934,869 which uses a feed mechanism which automatically increases or decreases a feed belt "foot print" or pressure on the bottom of a stack of sheets.

It is therefore a principle object of the invention to improve the separating and feeding of individual sheets from a stack.

It is another object of the invention to substantially increase the reliable retard life of sheet feed and separating apparatus.

It is another object of the present invention to greatly reduce the degradation of a sheet and any image on the sheet which are fed by sheet feeding and separating devices.

It is another object of the present invention to improve the feeding and separating of individual sheets from a stack irrespective of the characteristics of the sheet material.

It is another object of the present invention to reduce the force required from a subsequent transport to pull the sheet from sheet feeding and separating devices.

These objects and still others will become more apparent after a description of the invention to be read in conjunction with the drawings in which.

Figure 1:
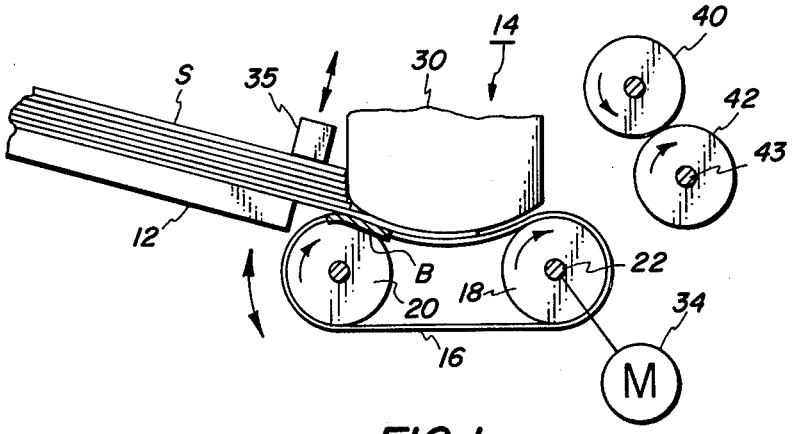
FIG. 1 is a schematic side view of one embodiment of the present invention.

Referring now to FIG. 1 the sheet feeding apparatus of the invention includes a sheet supply tray 12 supporting a stack of sheets S and a sheet feeding and separation apparatus 14. Sheet feeding and separating apparatus 14 includes a feed belt member 16 which is supported on a drive roll 18 and an idler roll 20. The belt member is formed of any suitable high friction material such as, rubber. Drive roll 18 is mounted on a shaft 22 having a stationary axis as will be explained more fully hereinafter. Disposed ontop of the stack is an abutment type retard member 30. A bail 35 is positioned on top of the stack to push the forward part of the stack down. For a complete description of the relationship between a feed belt member and an abutment type retard member and sheet stack on a tray reference is had to U.S. Pat. No. 3,768,803 referred to above and commonly assigned with the instant application.

Drive roll 18 is driven by a motor clutch mechanism 34 the motor being preferably constantly energized, the clutch associated therewith being activated by a suitable feed signal whenever a sheet to be fed is to be fed by the sheet feeding and separating apparatus 14.

Figure 2:
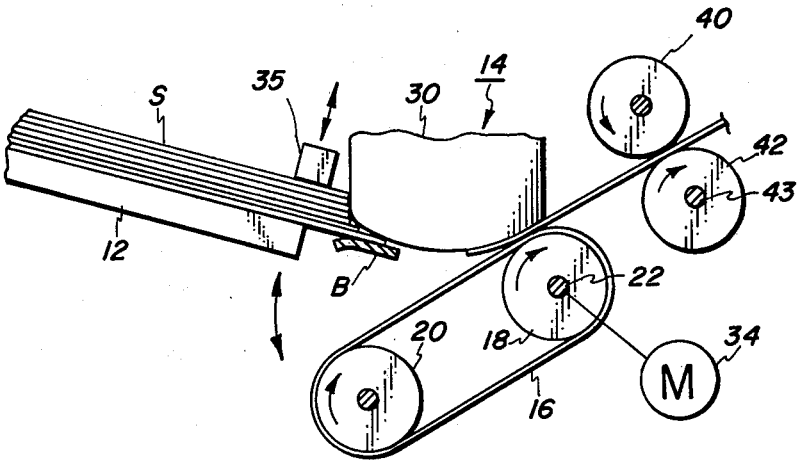
FIG. 2 is similar to FIG. 1 illustrating a particular operating position of the belt member.

When the bottom most sheet is advanced by the movement of the belt member 16 the sheet is received in the nip of transport rolls 40 and 42 which advance the sheet to intended destination which may be a platen of a copy of machine or the like. When the lead edge of the sheet reaches transport rolls 40 and 42 the frame supporting idler roll 20 is rotated in a counterclockwise direction about some convenient axis 22 such as shaft 22 as best shown in FIG. 2. Alternatively, the frame could be pivoted on axis 43 of roll 42.

It will now be appreciated that when retard member 30 is opened and the belt member 16 removed from contact with the stack of sheets an improved operation is accomplished. Specifically contamination and other degradation of the retard pad and the belt are greatly reduced. Furthermore with the belt in its retracted position away from the stack of sheets the drive force on the next and subsequent sheets of the stack is very small and therefore the probability of multi-feed is greatly reduced. Furthermore, degradation of the sheet being fed is greatly reduced as most of the sheet travels over the retard member 30 where the normal force is very small and the sheet does not contact the belt member 16. This is particularly important in the case where the sheet is a document since the small normal force and the lack of contact between the sheet and the belt will greatly reduce degradation of the image on the document. Moreover, transfer of the image from the document to the belt or the retard pad will be greatly reduced.

When the trail edge of the sheet being fed leaves the retard zone the frame carrying idler roll 20 is rotated clockwise to return the idler roll to its original position as shown in FIG. 1. The sheet feeding and separating apparatus is now ready to feed the next sheet. It will be appreciated that the frame that carries the idler roll 20 can carry a plurality of idler rolls that contact the stack when the frame is in the up position of FIG. 1. Also, a spring loaded idler to set the tension in the feed belt may be utilized. Furthermore, it will be appreciated that while the invention has been illustrated in a bottom feeding device it applies equally to a top feeding device.

A baffle B is located on either side of the feed belt so that the proper entrance geometry is maintained when the belt 16 is pulled away from the stack of sheets. Baffle B prevents a slug of sheets from sliding into the retard zone. When the trail edge of the sheet being fed is leaving the stack the belt member 16 is not in contact with the stack. Also the baffle B can be an extension of the tray 12. Therefore, the belt member cannot immediately start advancing the next sheet with the possibility of the lead edge of the next sheet will remain overlapped with the trail edge of the first sheet thereby causing a multi-feed condition. Thus, a failure of some of the existing sheet feeding device is thereby eliminated. Still another advantage with the above described invention is that it allows the transport rolls and feed belts to be driven at the same linear speed. Thus, there is no need to run transport rolls at speeds higher than the feed belt to create an inter-sheet gap which some of the existing devices require in order for the sheet to have a greater linear speed than the belt feeding the sheet in order to create an intersheet gap and avoid a multi-feed condition. The present invention creates the inter-sheet gap by not having the belt in contact with the stack.

Figure 3:
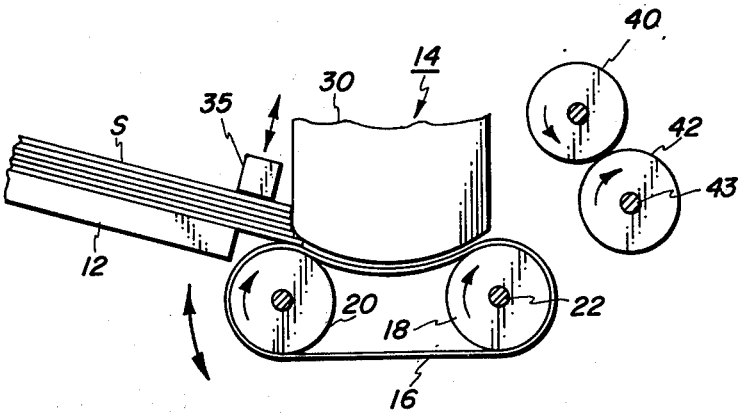
FIG. 3 is a schematic side view of a second embodiment of the present invention.

In FIG. 3 there is shown another embodiment where bail 35 which pushes the forward part of the stack down is made to lift after the lead edge of the first sheet of the stack being fed is in the retard nip. Alternatively, the bail 35 could be lifted at the same time that the feed belt member is dropped which would enable a simplified design.

Figure 4:
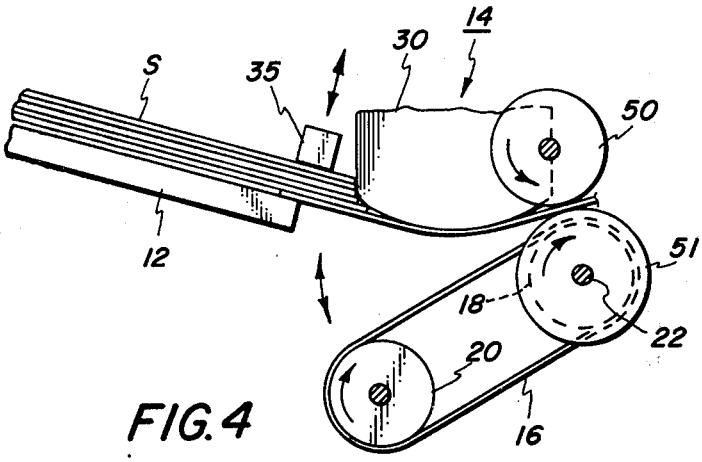
FIG. 4 is a schematic side view of a third embodiment of the invention.
Figure 5:
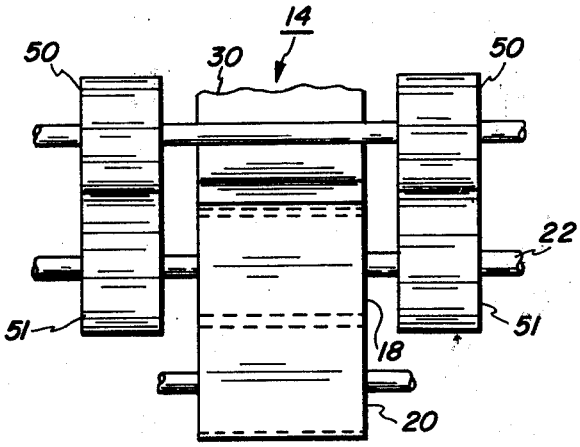
FIG. 5 is an end view of the embodiment shown in FIG. 4.
Figure 6:
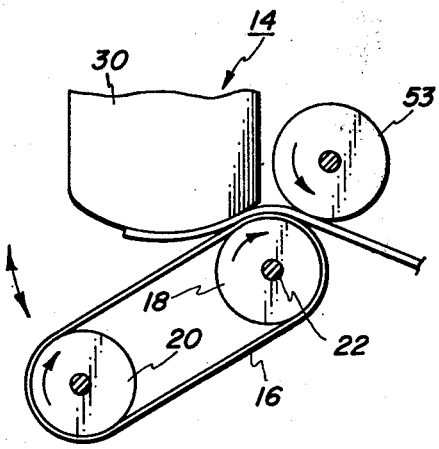
FIG. 6 shows an alternate embodiment of FIGS. 4 and 5.

In FIGS. 4 and 5 there is still another embodiment in which a pair of transport rolls 50 and 51 are positioned either side of the feed belt 16 and retard pad 30. Rolls 51 of each pair is mounted on the same shaft as the axis 22 of the drive roll 18 for feed belt 16. Alternatively, one transport roll 53 can be used as an idler in contact with the feed belt above the drive roll as shown in FIG. 6.

Figure 7:
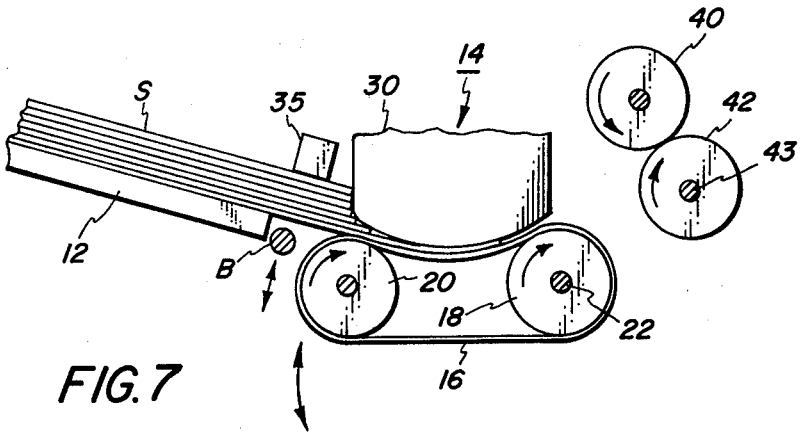
FIGS. 7 and 8 show still another embodiment of the invention similar to that of FIGS. 1 and 2.
Figure 8:
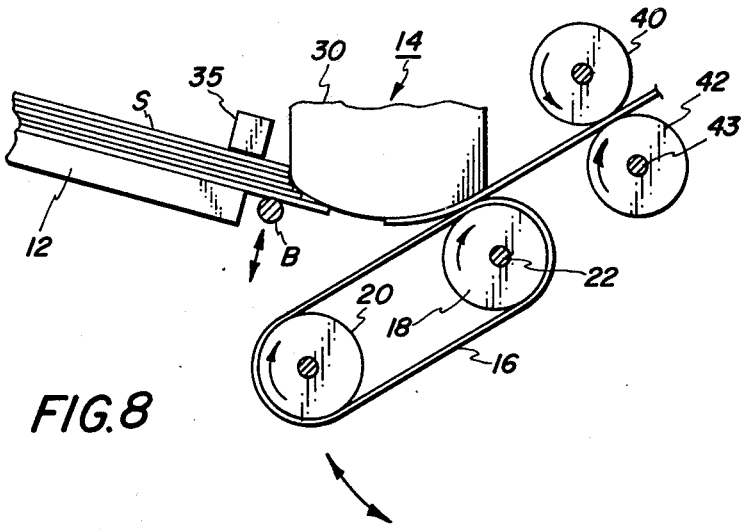

In still another embodiment as shown by FIGS. 7 and 8 the baffle B is movable. Thus, prior to the feed belt member 16 being moved away, the baffle is moved up. When the feed belt member is dropped the lead edge of the stack cannot drop down and advance into the retard zone.

Figure 9:
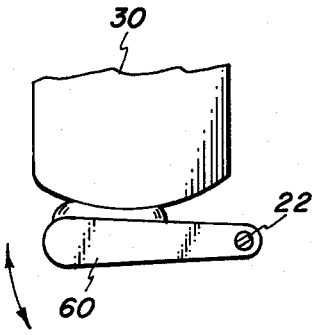
FIGS. 9 and 10 show still another embodiment of the invention similar to FIGS. 1 and 2 but including finger members in place of the baffle.
Figure 10:
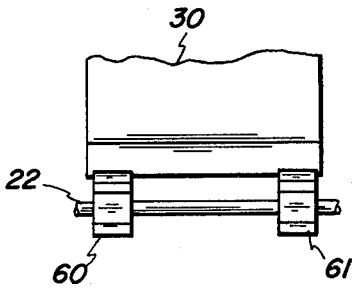

In the embodiment of FIGS. 9 and 10 the baffle B is shown as a pair of finger members 60 and 61. Finger members 60 and 61 hold up the lead edge of the stack when the feed belt member is down and act against the retard member 30 with the retard member being made wider than the feed belt member 16 as best shown in FIG. 10. The function of the finger members may be provided by two belts on either side of the feed belt 16. The finger member or belts remain in contact with the retard member 30 to maintain the proper entrance and nip geometry while the belt member 16 is moved away from the retard member. Finger members or belt 60, 61 can be made of any suitable material, such as Teflon, a trademark of E. I. DuPont DeNemours Co., that will produce minimal degradation of the sheet or image. Alternatively, a plurality of feed belt members 16 can be positioned on each side of the finger member or belt that maintains the geometry positioned on the center line.

It will be appreciated in all of the above described embodiments that air can be used to hold up the front of the stack while the feed belt 16 is down. The air supply can be turned down when the feed belt is moved away.

While there have been shown and described and pointed out the fundamental novel features of the invention as applied to a preferred embodiment, it will be understood that various omissions and substitutions and changes in the form and details of the device illustrated and in its operation may be made by those skilled in the art without departing from the spirit of the invention.

What is claimed is:

1. An apparatus for feeding and separating individual sheets from a stack of sheets which comprises in combination:

a belt member mounted adjacent the forward edge of the stack of sheets for feeding from the bottom of the stack;

friction retard means positioned along said forward edge of the stack to allow feeding of only one sheet beneath said friction retard;

sheet transport means positioned in the path to advance the sheets as they are fed by said belt member, said belt member being pivotable on an axis to move from a first position in contact with the bottom of the stack to a second position in a direction away from said stack whereby the retard forces on the sheet being fed are greatly reduced, wherein said sheet transport means includes a plurality of rolls coaxial with said pivot axis.

2. Apparatus according to claim 1 including baffle means positioned on the bottom of the stack to support said stack when the belt member is pivoted away from said stack.

3. Apparatus according to claim 2 wherein said baffle means is movable into and out of contact with said stack.

4. Apparatus according to claim 1 including bail means positioned on top of said stack.

5. Apparatus according to claim 4 wherein said bail means is movable into and out of contact with said stack.

6. Apparatus according to claim 1 wherein said sheet transport means includes at least one idler roll in contact with said belt member.

7. An apparatus for feeding and separating individual sheets from a stack of sheets which comprises in combination:

a belt member mounted adjacent the forward edge of the stack of sheets for feeding from the bottom of the stack;

friction retard means positioned along said forward edge of the stack to allow feeding of only one sheet beneath said friction retard;

sheet transport means positioned in the sheet path to advance the sheets as they are being fed by said belt member, said belt member being pivotable on an axis to move from a first position in contact with the bottom of the stack to a second position in a direction away from said stack whereby the retard forces on the sheet being fed are greatly reduced;

finger means in contact with said retard means to effect a proper nip when said belt member is pivoted away from said stack.

8. Apparatus according to claim 7 wherein said finger means is movable into and out of contact with said retard means.

* * * * *